US005259313A

United States Patent [19]

Gibson et al.

[11] Patent Number: 5,259,313

[45] Date of Patent: Nov. 9, 1993

[54] METHOD AND APPARATUS FOR CLEANING AN INKING MECHANISM AND/OR A PRINTING MECHANISM IN PRINTING UNITS OF ROTARY PRINTING MACHINES

[75] Inventors: Dave C. Gibson, Barrington, N.H.; Richard B. Mack, Heidelberg, Fed. Rep. of Germany; Glenn A. Guaraldi, Kingston, N.H.

[73] Assignee: Heidelberg Harris GmbH, Heidelberg, Fed. Rep. of Germany

[21] Appl. No.: 811,016

[22] Filed: Dec. 20, 1991

[51] Int. Cl.[5] ..... B41F 35/02; B41F 35/04

[52] U.S. Cl. ..... 101/425; 15/256.51

[58] Field of Search ..... 101/423, 424, 425; 15/256.51, 256.52, 256.53

[56] References Cited

U.S. PATENT DOCUMENTS

| | | | |
|---|---|---|---|
| 2,705,455 | 4/1955 | Buttner | 101/425 |
| 3,896,730 | 7/1975 | Garrett et al. | 101/425 |
| 3,952,654 | 4/1976 | Evans | 101/425 |
| 4,232,604 | 11/1980 | Waizmann | 101/425 |
| 4,686,902 | 8/1987 | Allain et al. | 101/425 |
| 4,875,412 | 10/1989 | Wright et al. | 101/425 |
| 4,905,596 | 3/1990 | Kobler | 101/425 |
| 5,003,877 | 4/1991 | Yano et al. | 101/425 |
| 5,020,433 | 6/1991 | Jeschke et al. | 101/425 |
| 5,046,416 | 9/1991 | Freyer et al. | 101/425 |
| 5,086,701 | 2/1992 | Gasparrini et al. | 101/425 |

FOREIGN PATENT DOCUMENTS

| | | | |
|---|---|---|---|
| 0441019 | 8/1991 | European Pat. Off. . | |
| 3900666 | 7/1990 | Fed. Rep. of Germany . | |
| 50144 | 3/1987 | Japan | 101/425 |
| 1357623 | 6/1974 | United Kingdom . | |

*Primary Examiner*—Edgar S. Burr
*Assistant Examiner*—Stephen R. Funk
*Attorney, Agent, or Firm*—Herbert L. Lerner; Laurence A. Greenberg

[57] ABSTRACT

A method of cleaning a mechanism having ink-conducting rollable cylindrical members in a printing unit of a rotary printing press includes spraying solvent into a nip between the ink-conducting rollable cylindrical members, rotating the ink-conducting rollable cylindrical members so as to squeeze the solvent through the nip between the rollable cylindrical members and thereby apply pressure in the nip to an ink/dampening solution mixture on the rollable cylindrical members for loosening the mixture, and removing loosened ink and impurities from the printing unit; and apparatus for performing the method.

17 Claims, 7 Drawing Sheets

METHOD AND APPARATUS FOR CLEANING AN INKING MECHANISM AND/OR A PRINTING MECHANISM IN PRINTING UNITS OF ROTARY PRINTING MACHINES

BACKGROUND OF THE INVENTION

1. Field of the Invention

The invention relates to a method and apparatus for cleaning an inking mechanism and/or a printing mechanism in printing units of rotary printing machines.

2. Description of the Related Art including Information Disclosed under 37 C.F.R. 1.97 to 1.99.

A method and apparatus for cleaning blanket cylinders in a web-fed printing machine has become known heretofore in the state of the art from German Patent 39 00 666. A characteristic measure of the method described therein is the introduction of cleaning liquid and the removal of dirt at several locations of the peripheral surface of the blanket cylinder. As viewed in the rotational direction of the blanket cylinder, a respective one of the locations at which the cleaning liquid is applied lies upstream of the gap or nip between the blanket cylinder and the web, and another of the locations downstream thereof yet upstream of a removal location formed by a wiper contact. It is possible only to clean the blanket cylinder with this heretofore-known method, without being able to clean the inking plate cylinder together therewith. After some use, the wiping material requires renewal by exchanging the winding coils or spools and, in addition thereto, cleaning liquid is applied to the web upstream of the nip or gap formed between the blanket cylinder and the web, the cleaning liquid being passed into a dryer and contributing there to an additional increase in the concentration of solvent.

SUMMARY OF THE INVENTION

Proceeding from this state of the art, it is an object of the invention to provide a method and apparatus for cleaning printing-unit cylinder in rotary printing machines wherein the time period required for the cleaning is markedly reduced while the concentration of solvent in the dryer is reduced.

With the foregoing and other objects in view, there is provided, in accordance with the invention, a method of cleaning inking and printing mechanisms in printing units of rotary printing presses, which comprises simultaneously or alternatively spraying solvent into a nip between ink-conducting cylinders in the printing mechanism, spraying solvent into a nip between ink-conducting rollers in the inking mechanism and rotating the cylinders and/or rollers so as to squeeze the solvent through the nips, respectively, between the cylinders and the rollers and thereby apply pressure in the nips to an ink/dampening solution mixture on the cylinders in the printing mechanism and/or on the rollers in the inking mechanism for rapidly loosening the mixture under the influence of the solvent, and removing loosened ink and impurities from the printing unit.

The great advantage derivable from this method according to the invention is that, due to the high pressure present in the nip between the ink-conducting printing-mechanism cylinders, a dissolution of the ink-/dampening-medium mixture is greatly accelerated and a uniform cleaning action is achievable over the entire width of the printing unit. At high speeds, the plate cylinder and the blanket cylinder are cleaned by dividing and distributing the cleaning medium on both cylinders in the nip. Due to the disposition of the washing device at the nip between the cylinders, the cleaning medium can be applied so that the time during which it acts upon the printing form on the plate cylinder, which feeds more ink than the blanket cylinder, is longer than for the latter. Supported by the intended spraying over substantially the entire width of the printing unit, and the dissolution of the ink/dampening-medium emulsion already in the nip between the ink-conducting printing-mechanism cylinders, a considerable amount of cleaning medium which would otherwise be applied can be dispensed with. Little cleaning medium reaches the web, and the introduction of cleaning medium into the dryer is considerably reduced.

In accordance with another aspect of the invention, there is provided an apparatus for wiping inking and printing mechanisms in printing units of rotary printing presses, comprising means for spraying solvent into a nip between ink-conducting cylinders in the printing mechanism and into a nip between ink-conducting rollers in the inking mechanism, means for rotating the cylinders and rollers so as to squeeze the solvent through the nips, respectively, between the cylinders and the rollers and thereby apply pressure in the nips to an ink/dampening solution mixture on the cylinders in the printing mechanism and on the rollers in the inking mechanism for loosening the mixture, and means for removing loosened ink and impurities from the printing unit.

It is then possible, furthermore, to clean the inking mechanism in parallel with the printing mechanism, and to remove the dissolved or loosened ink via the printing mechanism. This accelerates the cleaning process considerably. The ink residues can be removed by the cleaning devices, and the amount of cleaning solvent is capable of being precisely metered, thereby avoiding any excessive solvent concentration in the dryer. Moreover, cleaning solvent can be economized, and no cleaning cloths are required anymore. The cleaning of each printing unit can then be effected automatically by pressing a button.

In accordance with another feature of the invention, the printing mechanism of the printing unit includes a plate cylinder and a blanket cylinder, at least the blanket cylinder having a continuous outer cylindrical surface.

In accordance with a further feature of the invention, the printing mechanism of each of the printing units includes an ink-conducting plate cylinder and an ink-conducting blanket cylinder, and, opposite a nip between the cylinders, on a web outlet side of the respective printing unit, an engageable and disengageable washing device is disposed.

Thus, the plate cylinder and blanket cylinder in the respective printing mechanisms of a printing unit may be constructed without the usual channel formed therein, and the respective washing device disposed at the respective nip therebetween. This arrangement assures unhindered accessibility to the printing mechanisms for changing the printing forms and cylinder cloth covering or blanket. In this regard, the washing devices may merely be disengaged from the nip and swung out of the way or need not be removed at all, the blanket being removable through the frames on the work side of the machine and the printing forms or plates being installable also therethrough.

In accordance with an additional feature of the invention, the respective washing device has a printing nip guard, as well as a spray tube having spray openings formed therein over the width of the washing device. The spray openings are highly precisely machined as by a laser technique.

This offers the advantage of compact construction, the spray pipe being integratable with the printing nip protector. The wedge-shaped structure of the printing nip protector provides the advantage of utilizing the boundary layer forming at high speeds around the rotating printing-mechanism cylinders for shielding the surroundings of the printing mechanism. The fine droplets of cleaning solution or solvent are entrained by the suction air or draft back into the nip and do not impair or injure the operating personnel or the printing-mechanism environment.

In accordance with an additional feature of the invention, the apparatus includes a respective pivot arm for moving the respective washing device, and terminal switches for protectively limiting the respective washing device to adjusted positions thereof.

Operating control of the washing device can thereby be effected from a central remote-control console. The pivot arms carry the solvent feedlines.

In accordance with yet another feature, the apparatus according to the invention includes a wiping device operatively associated with the blanket cylinder, and means for remotely controlling the wiping device via an operating cylinder into and out of engagement with the blanket cylinders.

In accordance with yet a further feature, the wiping device is pivotably mounted in a respective side bracket, and a doctor blade is fastened to the wiping device for wiping off the outer cylindrical surface of the blanket cylinder.

The side brackets are fastenable relatively simply and rapidly to the walls of the printing mechanism, and the wiping devices are able to be assembled and disassembled quite easily.

In accordance with yet an additional feature of the invention, the wiping device has a trough, and a discharge pipe is connected to the trough. The mixture of paper dust, ink, dampening-medium and solvent or cleaning solution accumulate in the troughs or trays and is fed therefrom directly to treatment or purification equipment, so that a closed circuit or circulating loop is provided.

In accordance with yet a further feature of the invention, there are provided at least two inking-mechanism washing devices for feeding a solvent mixture parallel to the respective cylinder washing devices to inking rollers and distributor rollers in a printing unit, wiping devices engageable with the inking and the distributor rollers for removing impurities therefrom, and discharge pipes connected to a waste-water tank for receiving the impurities from the cleaning devices.

In accordance with yet an added feature of the invention, there is included at least at one printing unit, an air supply line having regulators connected therein, the respective wiping devices being connectible via a multiway valve to the air supply line.

The cleaning method is able to be shortened considerably thereby, and the ink and residues washed out of the inking and printing mechanisms are removed by the wiping devices at the printing mechanism of the printing unit and carried away.

In accordance with yet an additional feature of the invention, there is included a remotely controllable three-way valve for connecting the cylinder washing devices and the inking-mechanism washing devices for cleaning the respective printing unit via a respective remotely controllable multiway valve to a water pump and to a solvent pump for controlling the water pump and the solvent pump.

This permits individual adjustment and metering of solvent and water in the cleaning operations at the individual printing units. Targeted action can be taken at any time from a remote control center because of any special demands or requirements. The quantity of solvent is reduced, and down times are lessened.

In accordance with another feature of the invention, at least one of the printing units is connected via a water supply line to a water tank and via a solvent line to a solvent tank, and the wiping devices of at least one of the printing units is connected via discharge lines to a waste-water tank.

In this way, several printing units of a particular printing-machine configuration can be tied into the washing system with a closed cycle or circulating loop. The washing system, which is formed of printing-mechanism washing devices and inking-mechanism washing devices, cleans at least one printing unit by remote control through the economical, yet efficient introduction of solvent or cleaning solution while avoiding waste and economizing on setting or make-ready time.

In accordance with a further aspect of the invention, there is provided a method of cleaning a plate cylinder and a blanket cylinder of a web-fed rotary printing machine, which comprises: spraying solvent into a nip between the plate cylinder and the blanket cylinder while rotating the cylinders so that the solvent is squeezed through the nip and, due to the pressure in the nip, dissolves the ink on the cylinders, directing the sprayed solvent so that it remains on the plate cylinder for a longer working period than on the blanket cylinder, drying the plate cylinder with the blanket cylinder by at least partially transferring therefrom the solvent sprayed thereon as the two cylinders roll on one another, and drying the blanket cylinder and removing impurities therefrom with the web fed to the printing machine.

In accordance with an additional aspect of the invention, there is provided an apparatus for cleaning ink-conducting printing-mechanism cylinders in a web-fed rotary printing machine, comprising a washing device disposed opposite a nip between ink-conducting printing-mechanism cylinders on a side of a printing unit disposed opposite to a side thereof at which a web is fed into the printing unit.

In accordance with another feature of the invention, the washing device comprises a cylinder guard, and a spray bar integrated in the cylinder guard at an inlet to the nip.

In accordance with a further feature of the invention, the ink-conducting printing-mechanism cylinders are at least one plate cylinder and at least one blanket cylinder, at least the one blanket cylinder having an outer cylindrical surface formed without a channel, the washing device comprising a spray bar, and including wiping means disposed on the side of the printing unit opposite to the side thereof on which the washing device is disposed, the wiping means being in cooperative engagement with the at least one blanket cylinder without a channel in the outer cylindrical surface thereof.

In accordance with an added feature of the invention, there are included adjustable spray nozzles carried by the spray bar at a side thereof facing towards the nip, the spray nozzles being distributed over substantially the entire width of the printing unit.

In accordance with yet an added feature of the invention, there is provided a method of cleaning printing-mechanism cylinders in a rotary printing machine wherein at least one of the cylinders is a blanket cylinder, which comprises disposing a washing unit so as to cooperate with the blanket cylinder, applying solvent to the blanket cylinder from a spray bar pivotally secured in a housing of the washing unit, removing particles and liquid from the blanket cylinder by a plurality of devices disposed downstream from the spray bar in rotational direction of the blanket cylinder, and cleaning the devices for removing particles and liquid from the blanket cylinder by mutual engagement of the devices.

In accordance with a concomitant aspect of the invention, there is provided an apparatus for cleaning printing-unit cylinders in a rotary printing machine wherein at least one of the cylinders is a blanket cylinder, comprising a washing unit disposed adjacent the blanket cylinder, an operating cylinder connected to the washing unit for setting the washing unit into cleaning action on a cylinder packing of the blanket cylinder, the washing unit having a spray bar for applying solution to the cylinder packing, and a stripper for stripping impurities and liquid from the cylinder packing.

Other features which are considered as characteristic for the invention are set forth in the appended claims.

Although the invention is illustrated and described herein as embodied in a method and apparatus for cleaning an inking mechanism and a printing mechanism in printing units of rotary printing machines, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENTS

Figure 1:
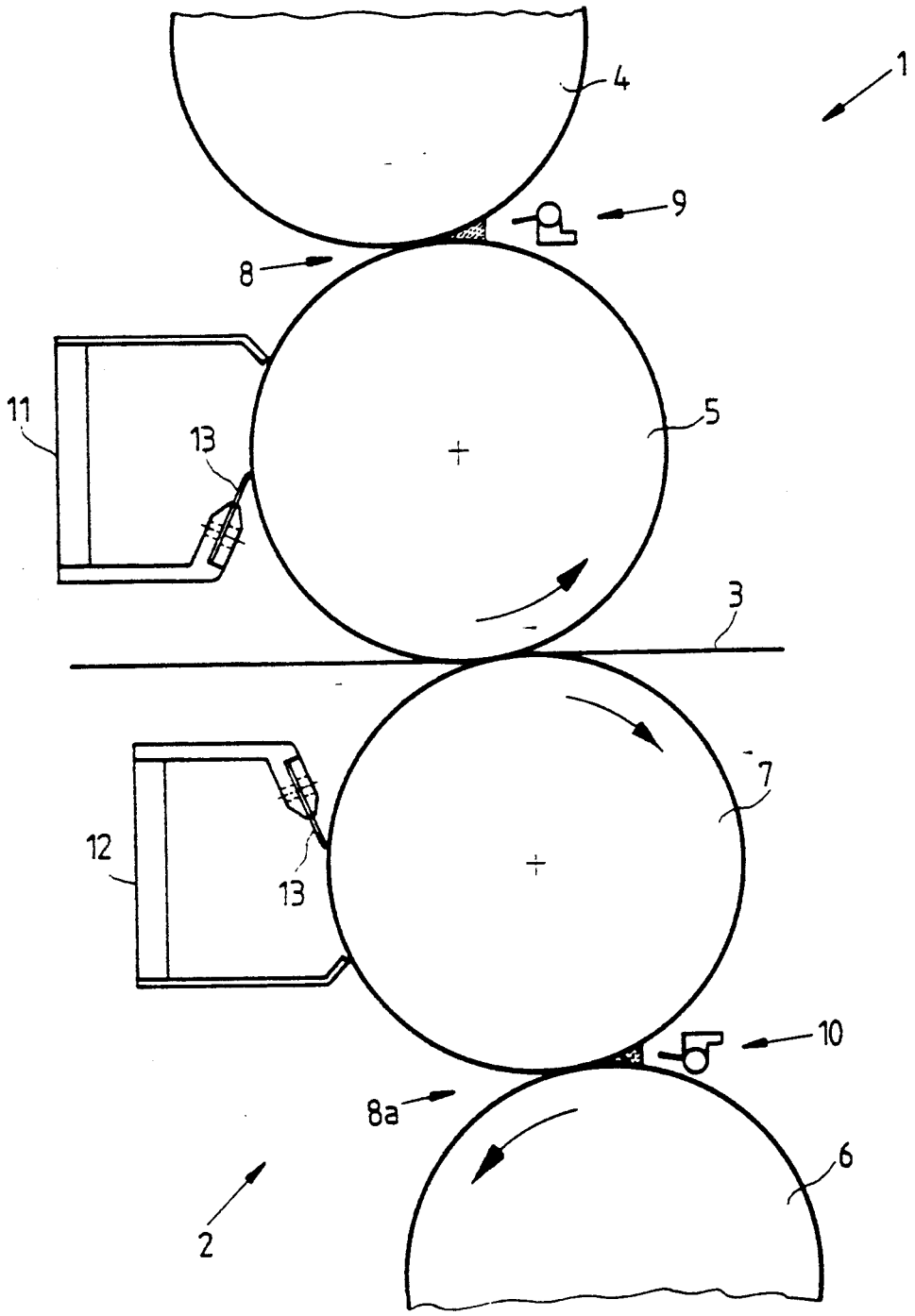
FIG. 1 is a diagrammatic side elevational view of a pair of printing mechanisms each having a washing device and a wiping device.

Referring now to the drawings and, first, particularly to FIG. 1 thereof, there is shown therein diagrammatically a pair of printing mechanisms with washing and wiping devices.

In an upper printing mechanism 1 and a lower printing mechanism 2, an oncoming paper web 3 is printed on both sides thereof. The upper printing mechanism 1 encompasses two ink-conducting cylinders, namely a plate cylinder 4 and a blanket cylinder 5. In the vicinity of a nip 8 between the printing-mechanism cylinders 4 and 5, a washing device 9 is disposed. A wiping device 11 is located opposite and adjacent the blanket cylinder 5 and is provided with a doctor blade 13. In the lower printing mechanism of FIG. 1, a wiping device 12 is assigned to a blanket cylinder 7 and is provided with a doctor blade 13. A washing device 10 is mounted in a nip **8*a* between a blanket cylinder 7 and a plate cylinder 6, and serves to apply solvent into the nip 8*a*** when washing.

The washing devices 9 and 10, respectively, extend over the entire width of the printing mechanism. By introducing the solvent directly into the respective nip 8, **8*a*, the ink/dampening-medium film on the printing-mechanism cylinders dissolves. The pressure due to the high compression in the nip 8, 8*a* promotes an intensive intermixing of the ink/dampening-medium mixture with the solvent. Because the plate cylinders 4 and 6 conduct a greater quantity of ink/dampening-medium, the time that the solvent acts upon the outer cylindrical surfaces thereof is of longer duration. The wiping devices 11 and 12, respectively, associated with the two blanket cylinders 5 and 7 remove the impurities directly from the packing of these printing-mechanism cylinders. This service is performed by the doctor blade 13 which is engageable with the outer cylindrical surfaces of the blanket cylinders 5 and 7 which have been formed without any cylinder channel or gap. In the cleaning of the ink-conducting blanket cylinders 5 and 7, the mixture of ink, dampening medium and solvent which has accumulated on the printing forms of the plate cylinder 4 and 6 is removed from the blanket cylinders 5 and 7 by strippers 13 and is delivered to the wiping devices 11 and 12**, respectively.

Figure 2:
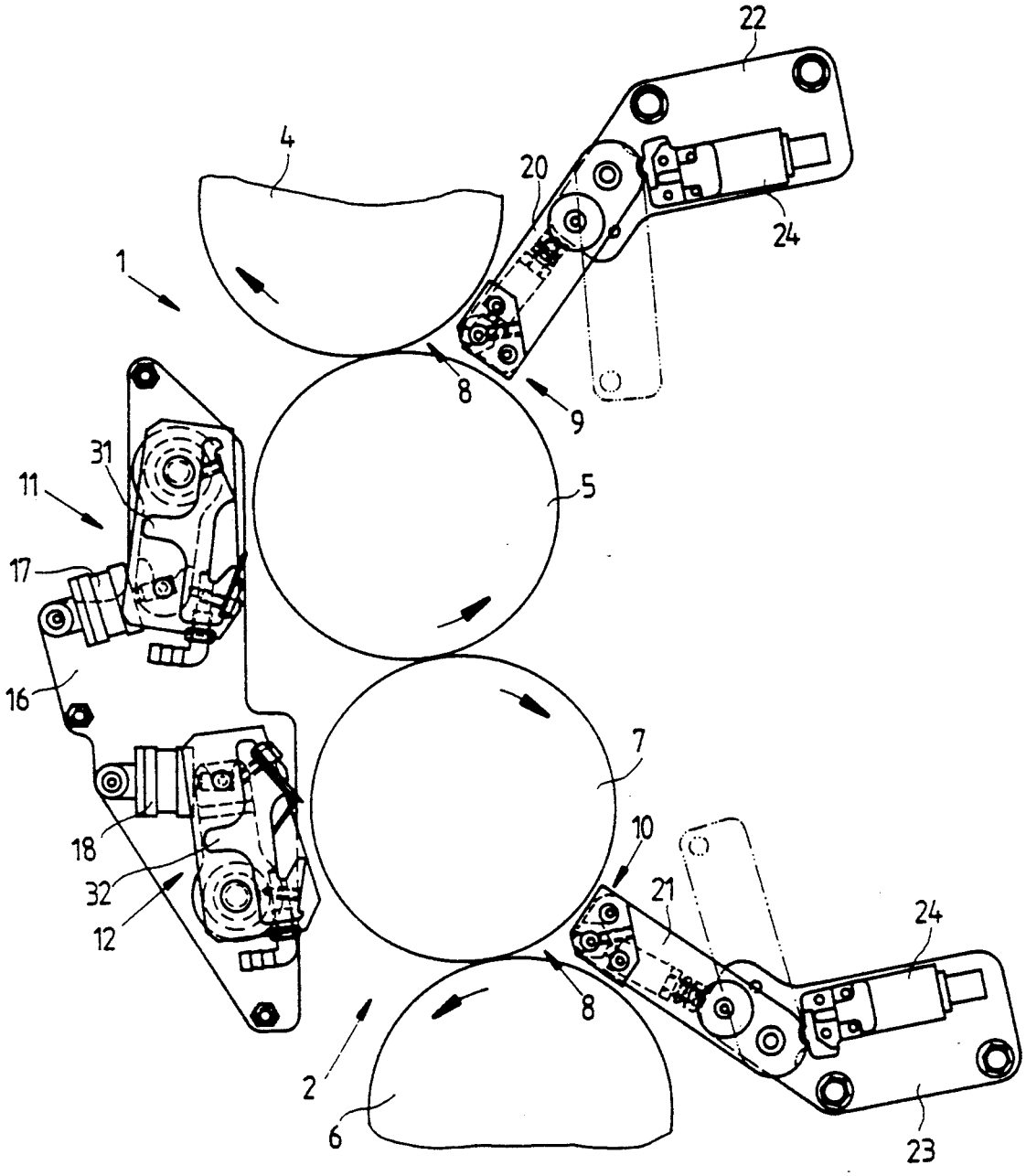
FIG. 2 is a slightly reduced view like that of FIG. 1 of an embodiment of the apparatus for cleaning printing-mechanism cylinders in accordance with the invention.

FIG. 2 shows an embodiment of the device for cleaning printing-mechanism cylinders according to the invention. As is readily apparent therein, two printing mechanisms, namely an upper printing unit 1 and a lower printing unit 2, are illustrated near which the wiping devices 11 and 12 are mounted on a side bracket 16. On the side opposite the side bracket 16, i.e. between the viewer and the plane of the drawing, another side bracket which is non-illustrated serves to support bearings for the cleaning devices 11 and 12 on that side. Further provided on the side bracket 16 are adjusting or control cylinders 17 and 18, via which troughs or trays 31 and 32, respectively, mounted in limiting walls 30 and 40 (note FIGS. 3 and 4) are engageable by remote control with the outer cylindrical surfaces of the blanket cylinders 5 and 7. The impurities on the outer cylindrical surfaces of the blanket cylinders 5 and 7 are removed by respective doctor blades 14 and 15, as shown more clearly in FIG. 4. Connectors for discharge pipes 19 are attached to the troughs 31 and 32, so that the mixture removed from the cylinder surfaces can be conducted directly into a circuit serving for treating or purifying the solvent.

Washing devices 9 and 10 are mounted opposite the nips 8 and 8a at the web outlet side of the upper and lower printing units 1 and 2. The washing devices 9 and 10 are mounted in pivot arms 20 and 21, which also carry feed lines 44 for the solvent, one of which is shown in broken lines in FIG. 5.

The pivot arms 20 and 21 are mounted in plates 22 and 23 which also carry terminal switches 24. The pivot arms 20 and 21 are also shown in phantom in FIG. 2, when the washing devices 9 and 10 are in a withdrawn disengaged position. The security of the adjusted positions of the pivot arms 20 and 21 is maintainable by the terminal switches.

Figure 3:
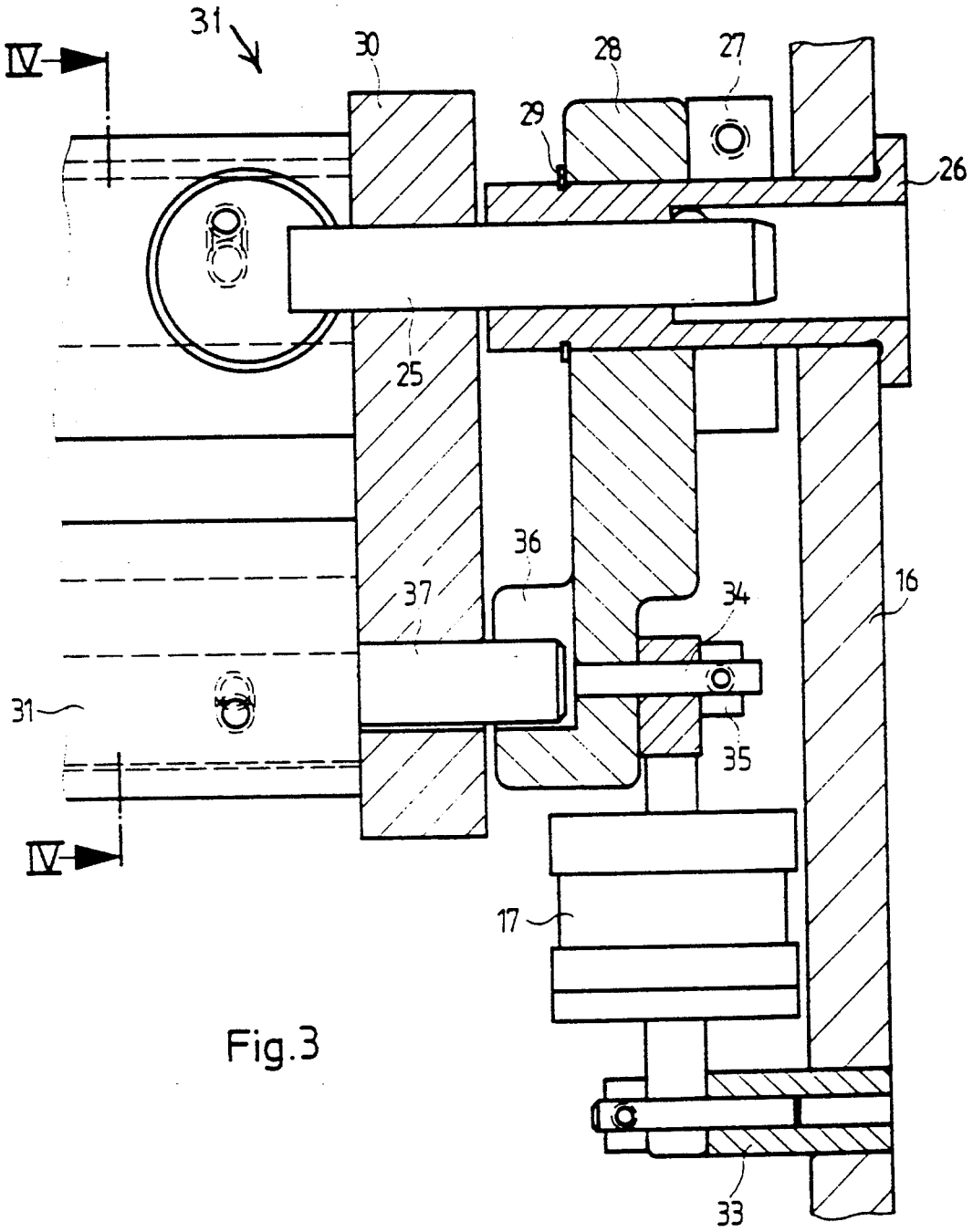
FIG. 3 is a much-enlarged fragmentary cross-sectional view of FIG. 2 showing the mounting of the wiping device on a side bracket.

FIG. 3 shows the mounting of the wiping device 11 on the side bracket 16. The trough or tray 31 of the wiping device 11 is mounted on a limiting wall 30 which, in turn, is held by a pin 25, with a ring fastened to an end thereof, in a bushing 26. At the bottom of the limiting wall 30, the latter is mounted by means of a pin 37 in a recess 36 of a pivot arm 28. The pin 25 is inserted into the bore of a bushing 26 which, in turn, is fitted into the side bracket 16. This bushing 26 carries an adjusting ring 27, the pivot arm 28, as well as a retaining ring 29, with which the axial position of the pivot arm 28 on the bushing 26 is fixable. The side bracket 16 also carries a counterbearing 33 for the adjusting or control cylinder 17. A piston rod for the control cylinder 17 is connected to a pin 34 which is provided with a retaining nut 35 or the like. The pin 34 is mounted in the pivot arm 28 and moves the latter about a pivot shaft formed by the bushing 26.

The spatial arrangement of the parts of the device according to the invention with respect to one another is illustrated in FIG. 2.

The disassembly or removal of the trough or tray 31 from the side bracket 16 is effected rather simply by withdrawing the pins 25 out of the bushings 26 with the aid of the respective rings fastened to the end of the pins 25, and the trough 31 together with the limiting wall 30 and the pin 37 is lifted out of the recess 36. Little time is required for this purpose. The exchange of the troughs 31 can occur in a few seconds, and the cleaning of the troughs 31 occurs outside the printing machine.

Figure 4:
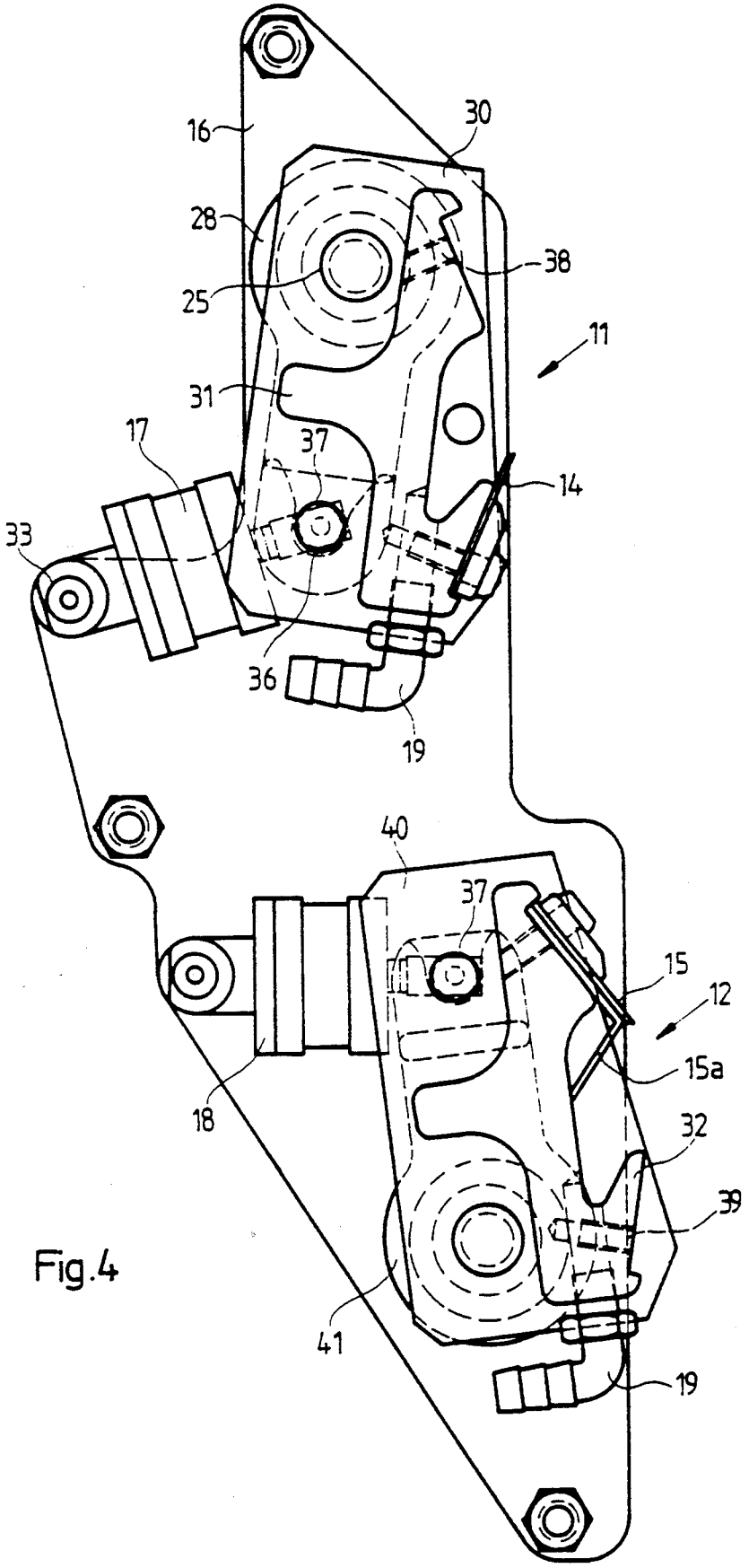
FIG. 4 is an enlarged fragmentary view of FIG. 2 showing two cleaning devices actuatable by operating cylinders and mounted on a side bracket.

FIG. 4 shows, in a side view, two wiping devices 11 and 12 actuatable by control cylinders 17 and 18. The doctor blades 14 and 15 are screwed or bolted to front edges of the respective troughs 31 and 32. Additional threaded bores 38 and 39, respectively, are formed in the troughs 31 and 32 if the doctor blades 14 and 15 are remounted. A deflecting plate 15a is mounted below the doctor blade 15 for conducting spattered ink and dampening medium mixture into the trough 32. Spattered liquid drops are also hurled against the deflecting plate 15a due to centrifugal force, and run together into the trough 32 from which they are discharged via a discharge line 19.

In FIG. 4, the recess 36 wherein the pins 37 are hooked or suspended in order to permit rapid assembly and disassembly is also visible. In contrast with the limiting wall 30 of the wiping device 11, the limiting wall 40 of the cleaning device 12 is constructed so that the recess into which the pin 37 is inserted is located above the pivot axis of the pivot arm 41. The side brackets 16 are fastened to the machine walls of the upper and lower printing units 1 and 2. This facilitates accessibility and permits relatively simple disassembly.

Figure 5:
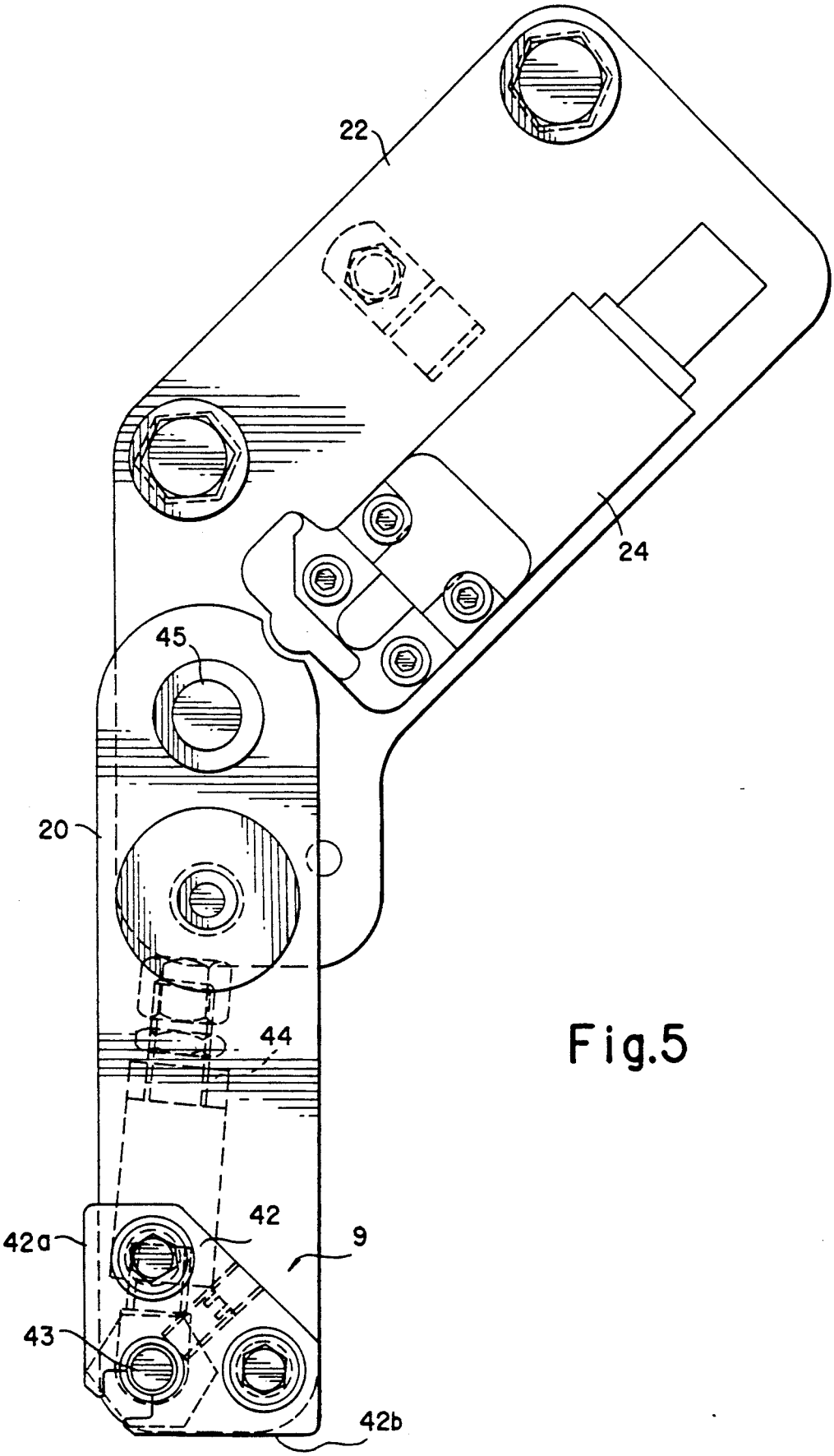
FIG. 5 is another enlarged fragmentary view of FIG. 2 showing the washing device including pivot arms, a printing-gap guard, a spray tube and terminal switches mounted on a plate.

FIG. 5 shows a plate 22 with a mounting for the pivot arm 20, a printing nip guard 42, a spray pipe 43, as well as a terminal switch 24. As shown in this figure, the plate 22 carries the terminal switch 24 which has a protuberance engaging in a small recess formed on the pivot arm 20. The position of the pivot arm 20 is thereby perceived and displayed. The pivot arm 20 turns about the pivot shaft 45. This can be effected electrically by means of an adjusting drive as well as by an adjusting cylinder subjected to a pressure medium, i.e., hydraulically or pneumatically. Feed lines 44 for the solvent are carried in the pivot arm 20. The spray pipe 43 is integrated in the printing nip guide 42 at the end of the pivot arm 20. This spray pipe 43 is formed with a multiplicity of mutually adjacent, highly precisely machined spray openings at a side thereof located opposite the nip 8. Solvent is sprayed out of the spray pipe 43 and into the nip 8 through these spray openings which, in this embodiment, for example, are formed by laser machining. Through this sprayed-in finely divided solvent, the dissolution or loosening of the ink/dampening-medium mixture of the outer cylindrical surfaces of the printing-mechanism cylinders is promoted. An acceleration of the cleaning process can be achieved. The printing nip guard 42 has a substantially triangular cross section of which a front edge, adjacent which the spray pipe 43 is located, faces towards the respective nip 8, 8a. Lateral edges 42a and 42b of the triangular cross-section profile approximately match the contour of the ink distributing cylinder. The gap formed between the peripheral surface of the rotating printing-unit cylinder and the lateral edges 42a and 42b of the printing nip guard 42 produces an air current or draft through which the droplets are drawn back into the respective nip 8, 8a.

Figure 6:
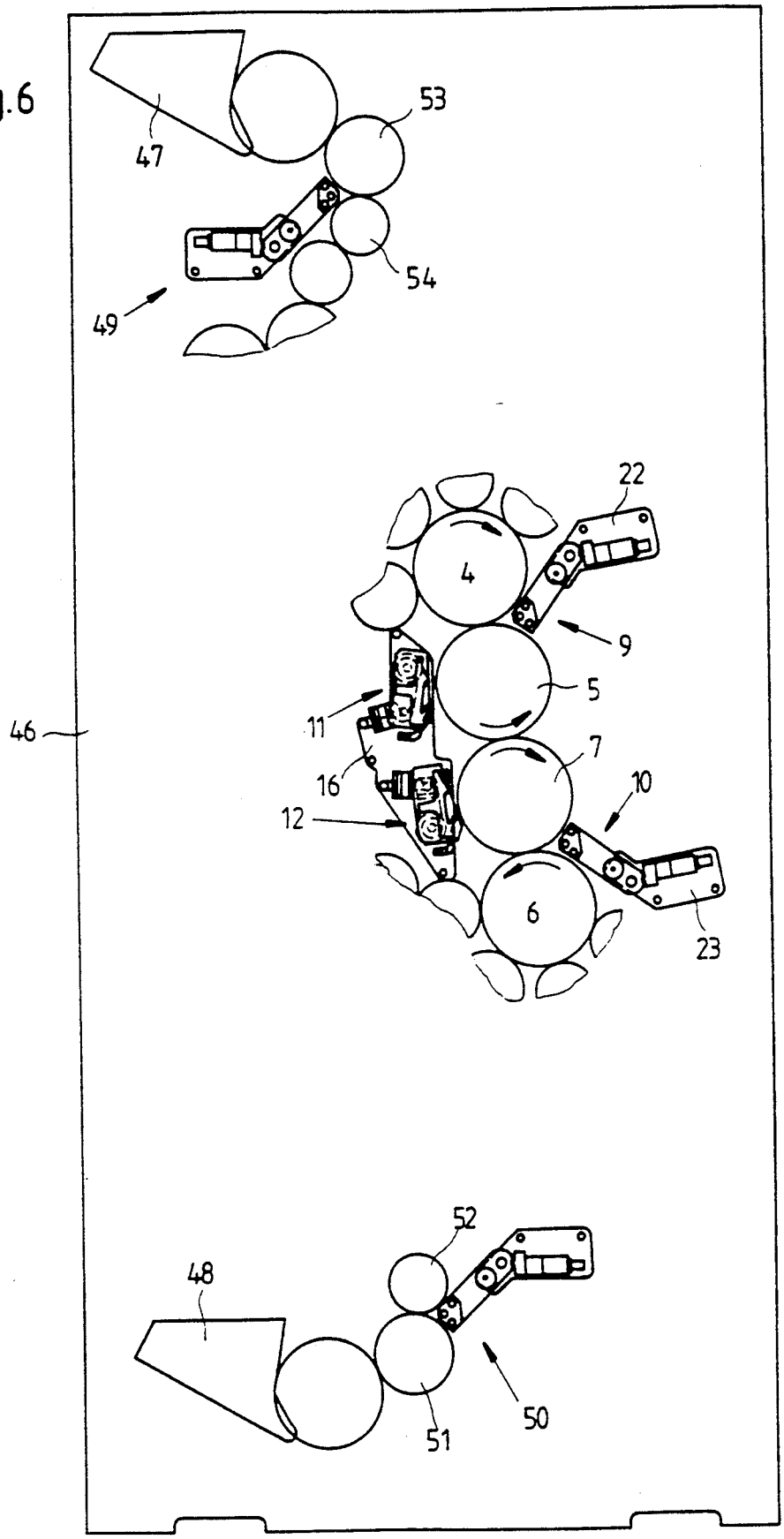
FIG. 6 is a diagrammatic side elevational view of printing units of a printing machine.

FIG. 6 shows a printing unit 46 which is furnished with printing-mechanism washing devices 9 and 10, as well as with inking-mechanism washing devices 49 and 50. As is readily apparent from FIG. 6, the location at which solvent is introduced into the printing mechanism 1 is between the plate cylinder 4 and the blanket cylinder 5. The point of introduction of the solvent into the printing mechanism 2 is between the plate cylinder 6 and the blanket cylinder 7.

In the inking-mechanisms located at the top as well as at the bottom of the printing unit 46 in FIG. 6, a similar layout exists. In the inking mechanism assigned to the printing mechanism 1, i.e., with the cylinders 4 and 5, the inking-mechanism washing device 49 is built-in in such a manner that the solvent is sprayed into the nip between an inking roller 53 and a distributor roller 54. By means of this inking-mechanism washing device 49, the respective inking mechanism is washed and the washed-out ink residues are removed by means of the wiping device 11 which is engageable with the blanket cylinder 5 of the printing mechanism 1. Analogously, the foregoing applies as well as to the inking-mechanism washing device 5 which is assigned to the inking mechanism for the printing-mechanism 2, i.e., with the cylinders 6 and 7, and the solvent is sprayed into the nip between an inking roller 51 and a distributor roller 52. Thus, the lower part of the printing unit 46 as viewed in FIG. 6, is cleaned, and the washed-out ink residues are removed from the printing mechanism 2 by the wiping device 12. No additional pump is required with this washing system, because the inking-mechanism washing devices can be connected to the printing-mechanism cleaning devices. Thus, an automatic cleaning of an entire printing unit 46 is able to be accomplished. The washing device for both the inking mechanism and the printing mechanism can have a like construction and can be readily interchanged in accordance with modular principles. The cleaning of the inking mechanism may be effected with or without a paper web in the printing unit 46, because the impurities are removed by the wiping devices before they can reach the web.

Figure 7:
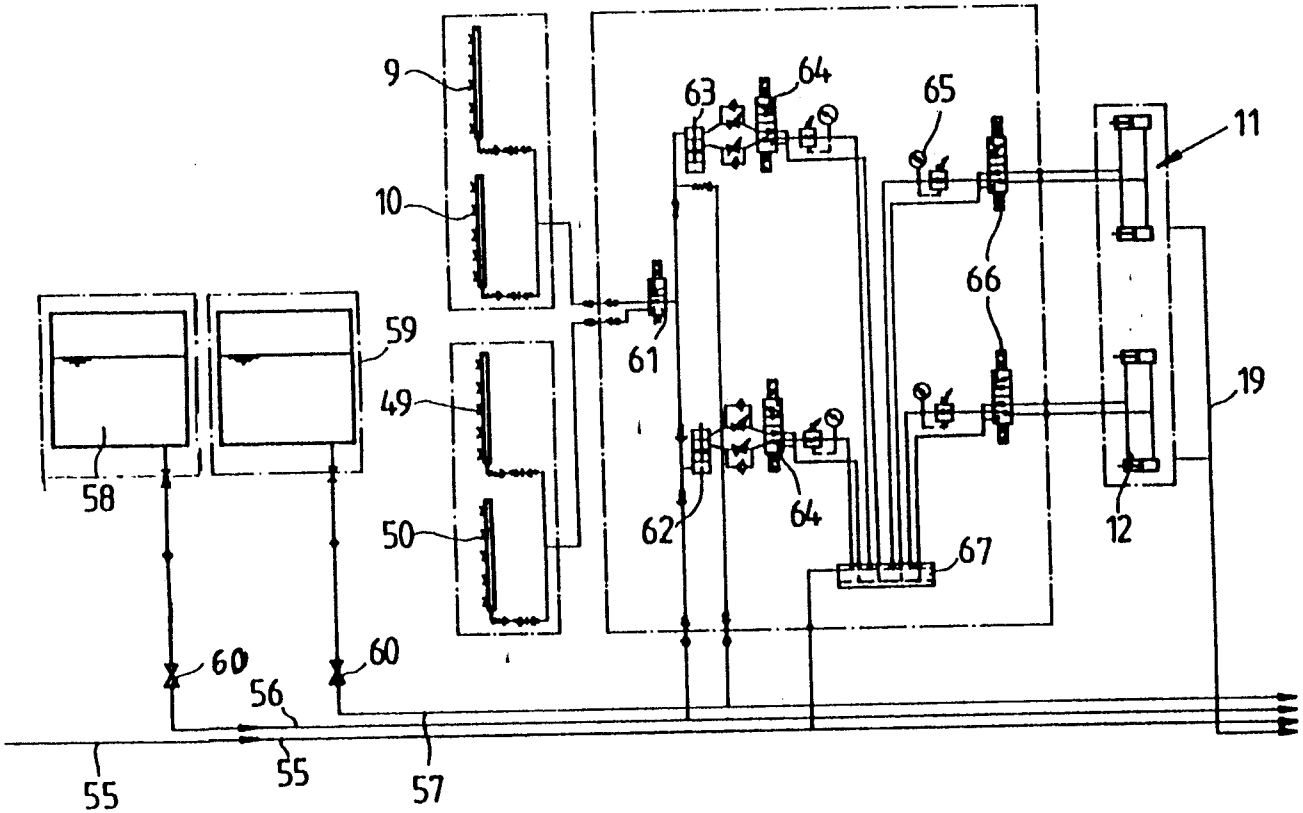
FIG. 7 is a circuit diagram showing how a printing unit is tied into supply and disposal modules.

FIG. 7 illustrates the tie-in of a printing unit into supply and disposal modules. The printing unit 46 (FIG. 6) is supplied with air via an air supply line 55 which is connected to a compressed air distributor 67. Compressed air is thus delivered to regulators 65 which, via multiway valves 64 and 66, permits actuation of adjusting or control cylinders at the wiping devices 11 and 12, as well as the application of the compressed air to a water pump 62, as well as a solvent pump 63. The multiway valves 64 and 66 are actuatable for example, electromagnetically, from a control desk by remote control. A water tank 58 is connected to the water pump 62 via a water supply line 56 with a throttle or pressure-regulating valve 60 connected intermediately thereto. Analogously, the solvent tank 59 is connected via a solvent line 57, likewise with a throttle or pressure-regulating valve 60, to the solvent pump 63. A three-way valve 61 permits a water/solvent mixture, which is able to be metered on demand via the multi-way valve 64, either to be fed to the washing devices 9 and 10 for the printing mechanisms 1 and 2 separately, or the water/solvent mixture to be fed to the inking-mechanism washing devices 49 and 50, or the water/solvent mixture to be fed to the washing devices 9, 10, 49 and 50 simultaneously. The wiping devices 11 and 12 are pneumatically engageable or disengageable via the multiway valve 66. The wiping devices 11 and 12 are engageable with blanket cylinders 5 and 7, respectively, and remove from the outer cylindrical surfaces thereof ink residues which have been washed out of the inking mechanism. The washed-off ink/dampening-medium emulsion of the printing form, as well as paper dust and the like, forming the residues, accumulate in the troughs 31 and 32 (FIG. 4) of the respective wiping devices 11 and 12 and are conducted via a discharge or drain line 19 into a non-illustrated waste-water tank.

FIG. 7 also shows the tie-in of the printing unit 46 with a washing system. It is readily apparent that all of the printing units of a rotary printing machine ma be connected to such a system. Thus, also ink ducts 47 and 48 (FIG. 6), for example, may be included in the washing system and may be cleaned in parallel with the inking and printing mechanisms.

We claim:

1. In a printing unit of a rotary printing press having inking and printing mechanisms, apparatus for cleaning the inking and printing mechanisms comprising means for spraying solvent in respective given directions into a nip between ink-conducting cylinders in the printing mechanism simultaneously along the entire width of said ink-conducting cylinders of the printing mechanism and into a nip between ink-conducting rollers in the inking mechanism simultaneously along the entire width of said ink-conducting rollers of the inking mechanism, an engageable and disengageable washing device disposed opposite the nip between the ink-conducting cylinders in the printing mechanism, said solvent-spraying means for said ink-conducting cylinders being included in said engageable and disengageable washing device, a respective pivot arm for moving said washing device, terminal switches for protectively limiting said washing device to adjusted positions thereof, means for rotating the cylinders and rollers in the given direction at the respective nips so as to squeeze the solvent through said nips, respectively, between said cylinders and said rollers and thereby apply pressure in said nips to an ink dampening solution mixture on said cylinders in the printing mechanism and on said rollers in the inking mechanism for loosening said mixture, and means for removing loosened ink and impurities from the printing unit.

2. Apparatus according to claim 1, wherein the ink-conducting cylinders of the printing mechanism include a plate cylinder, and a blanket cylinder formed with a continuous outer cylindrical surface.

3. Apparatus according to claim 1, wherein the printing unit has an upper and a lower printing mechanism, respectively including one of the ink-conducting cylinders formed as a channel-free blanket cylinder.

4. Apparatus according to claim 1, including a plurality of printing units and wherein each of the printing units has a respective printing mechanism, and said ink-conducting cylinders thereof are an ink-conducting plate cylinder and an ink-conducting blanket cylinder.

5. Apparatus according to claim 4, including a wiping device comprising said removing means and operatively associated with said blanket cylinder, and means for remotely controlling said wiping device via a control cylinder into and out of engagement with said blanket cylinder.

6. Apparatus according to claim 5, wherein the blanket cylinder has an outer cylindrical surface, said wiping device is pivotally mounted in a respective side bracket, and a doctor blade is fastened to said wiping device for cleaning the outer cylindrical surface of the blanket cylinder.

7. Apparatus according to claim 5, wherein said wiping device has a trough, and including a discharge pipe connected to said trough.

8. Apparatus according to claim 5, including at least one inking-mechanism washing device for feeding a solvent mixture parallel to the cylinder washing device to inking rollers and distributor rollers in the printing unit, wiping devices engageable with said inking and said distributor rollers for removing impurities therefrom, and discharge pipes connected to said wiping devices for receiving therefrom and discharging said impurities.

9. Apparatus according to claim 8, wherein said cylinder washing devices and said inking-mechanism washing devices form a washing system having means for wiping off at least one of the printing units by remote control.

10. Apparatus according to claim 5, including an air supply line having regulators connected therein, the control cylinder for the respective wiping device being connected via a multiway valve to said air supply line.

11. Apparatus according to claim 1, wherein said washing device has a printing nip guard, as well as a spray tube having spray openings formed therein over the width of said washing device.

12. Apparatus according to claim 1, wherein said washing device is disposed opposite the nip between the ink-conducting cylinders on a side of the printing unit disposed opposite to a side thereof at which a web is fed into the printing unit.

13. Apparatus according to claim 12, wherein said washing device comprises a printing nip guard, and said spraying means comprise a spray bar integrated in said printing nip guard at an inlet to said nip between the ink-conducting cylinders 14. Apparatus according to claim 13, including adjustably mounted spray nozzles carried by said spray bar at a side thereof facing towards said nip, said spray nozzles being distributed over substantially the entire width of the printing unit.

15. Method of cleaning from a plate cylinder and a blanket cylinder of a web-fed rotary printing machine ink which has been deposited thereon, which comprises: spraying solvent in a given direction into a nip between the plate cylinder and the blanket cylinder simultaneously along the entire width of the cylinders while rotating the cylinders in the given direction at the nips so that the solvent is squeezed through the nip and, due to the pressure in the nip, dissolves the ink on the cylinders, directing the sprayed solvent so that it remains on the plate cylinder for a longer working period than on the blanket cylinder, drying the plate cylinder with the blanket cylinder, and drying the blanket cylinder and removing impurities therefrom with the web fed to the printing machine.

16. In a printing unit of a web-fed rotary printing machine having ink-conducting printing-mechanism cylinders, apparatus for cleaning the ink-conducting cylinders, comprising a washing device disposed opposite a nip between ink-conducting printing-mechanism cylinders on a side of the printing unit disposed opposite to a side thereof at which a web is fed into the printing unit, the ink-conducting printing-mechanism cylinders being at least one plate cylinder and at least one blanket cylinder, at least one of said cylinders having an outer cylindrical surface formed without a channel, said washing device comprising a spray bar, and including wiping means disposed on said side of said printing unit opposite to the side thereof on which said washing device is disposed, said wiping means being in cooperative engagement with said at least one cylinder without a channel in the outer cylindrical surface thereof.

17. Apparatus according to claim 16, including adjustably mounted spray nozzles carried by said spray bar at a side thereof facing towards said nip, said spray nozzles being distributed over substantially the entire width of the printing unit.

* * * * *